US005150765A

United States Patent [19]

Chen

[11] Patent Number: 5,150,765

[45] Date of Patent: Sep. 29, 1992

[54] FIRE ESCAPE

[76] Inventor: Yen-Huang Chen, No. 5, Tapeng Rd., Taichung, Taiwan

[21] Appl. No.: 742,841

[22] Filed: Aug. 8, 1991

[51] Int. Cl.[5] ..... A62B 1/20

[52] U.S. Cl. ..... 182/48; 193/12; 193/32

[58] Field of Search ..... 182/48, 49; 193/12, 193/32

[56] References Cited

U.S. PATENT DOCUMENTS

| | | | |
|---|---|---|---|
| 715,560 | 12/1902 | Dedrick | 182/48 |
| 3,656,579 | 4/1972 | Fisher | 182/48 |
| 3,968,856 | 7/1976 | Keen | 182/48 |
| 4,037,685 | 7/1977 | Talucci | 182/48 |

FOREIGN PATENT DOCUMENTS

| | | | |
|---|---|---|---|
| 1038095 | 5/1953 | France | 182/48 |

*Primary Examiner*—Reinaldo P. Machado

*Attorney, Agent, or Firm*—Hedman, Gibson & Costigan

[57] ABSTRACT

A fire escape including a housing formed in a building which includes a number of levels each having an opening communicated with the housing, and a number of buffer plates disposed in the housing in a stagger type. People can be safely dropped to the ground via the buffer plates. A helical pathway can be disposed in the housing so that people can slide to the ground in a fast speed via the helical pathway. The buffer plates and the helical pathway can be used as recreational purposes.

1 Claim, 2 Drawing Sheets

FIRE ESCAPE

BACKGROUND OF THE INVENTION

1. Field of the Invention

The present invention relates to a fire escape, and more particularly to a fire escape with which people can easily escape to safety place in a fast speed.

2. Description of the Prior Art

Various kinds of fire escapes are developed and include stairway or staircase which is generally used as the passage to go upstairs and downstairs. It is very time consuming to go downstairs via the stairs. The fire escapes also include other types of devices, such as a long sleeve which is made of elastic band type materials and with which people can escape to the ground from a high building in a fast speed. However, it takes time to prepare and to hang the sleeve firmly in place. In addition, each level should prepare one of such devices such that the people live in each of the levels can escape to the ground. This is inconvenient.

The present invention has arisen to mitigate and/or obviate the afore-described disadvantages of the conventional fire escape.

SUMMARY OF THE INVENTION

The primary objective of the present invention is to provide a fire escape with which people can easily escape to safety place in a fast speed.

In accordance with one aspect of the invention, there is provided a fire escape including a housing formed in a building which includes a number of levels each having an opening communicated with the housing, and a number of buffer plates disposed in the housing in a stagger type. People can be safely dropped to the ground via the buffer plates.

In accordance with another aspect of the invention, there is provided a helical pathway disposed in the housing so that people can slide to the ground in a fast speed via the helical pathway.

The buffer plates and the helical pathway can be used as recreational purposes.

Further objectives and advantages of the present invention will become apparent from a careful reading of the detailed description provided hereinbelow, with appropriate reference to the accompanying drawings.

DETAILED DESCRIPTION OF THE INVENTION

The fire escape in accordance with the present invention generally provides an idea and an escaping means with which people can easily escape to the safety place, such as ground, in a fast speed without any preparation processes.

Figure 1:
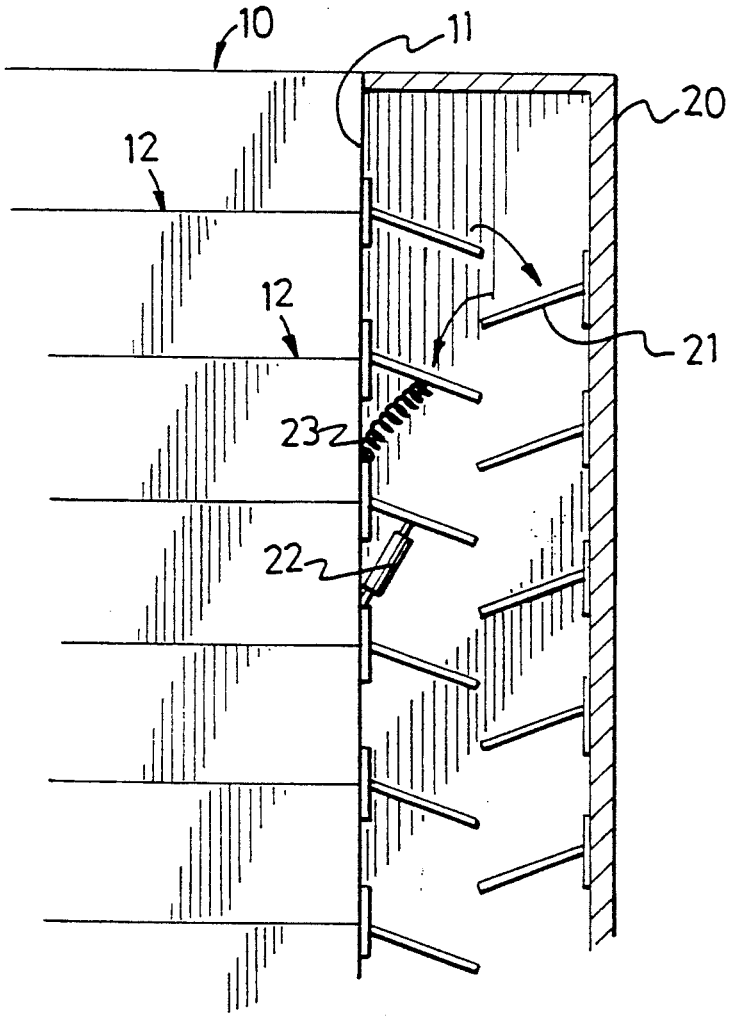
FIG. 1 is a partial plane view of a building embodying the fire escape in accordance with the present invention.

Referring to the drawings and initially to FIG. 1, the fire escape in accordance with the present invention comprises generally a housing 20 preferably formed on one side of a building 10 which includes a plurality of levels 12. An opening 11 is formed and provided on each of the levels 12 of the building 10. A plurality of buffer plates 21, such as resilient plates, are disposed in the housing 20 in a staggered type and are slightly inclined downward, in which one of the buffer plates 21 extends from the floor portion of each of the levels 12 of the building 10, and one disposed on the other side of the housing 20 and disposed in the middle portion of each level 12 of the building 10, such that the height between every two adjacent buffer plates 21 is equal to half of the height of each level of the building and is close to one man high.

The buffer plates 21 are preferably made of fire resistant materials and can be resiliently held in place by such as springs 23 or pneumatic and hydraulic cylinders 22 such that the load of the people jumped onto the buffer plate can be absorbed by the springs 23 or the cylinders 22 and such that people will not be hurt when he jumped onto either of the buffer plates 21. Accordingly, people can easily go to any of the lower stairs via the buffer plates 21. It is to be noted that the height between the buffer plates is arranged such that people will not be hurt even when he is dropped down or fallen down to the ground via the buffer plates 21. Accordingly, people can move down to the ground in a fast speed. A shock absorption device, such as a pad, a pool or a plurality of spongy materials or balls can be disposed on the ground portion of the housing 20 such that people will not be hurt when he dropped to the ground.

Figure 2:
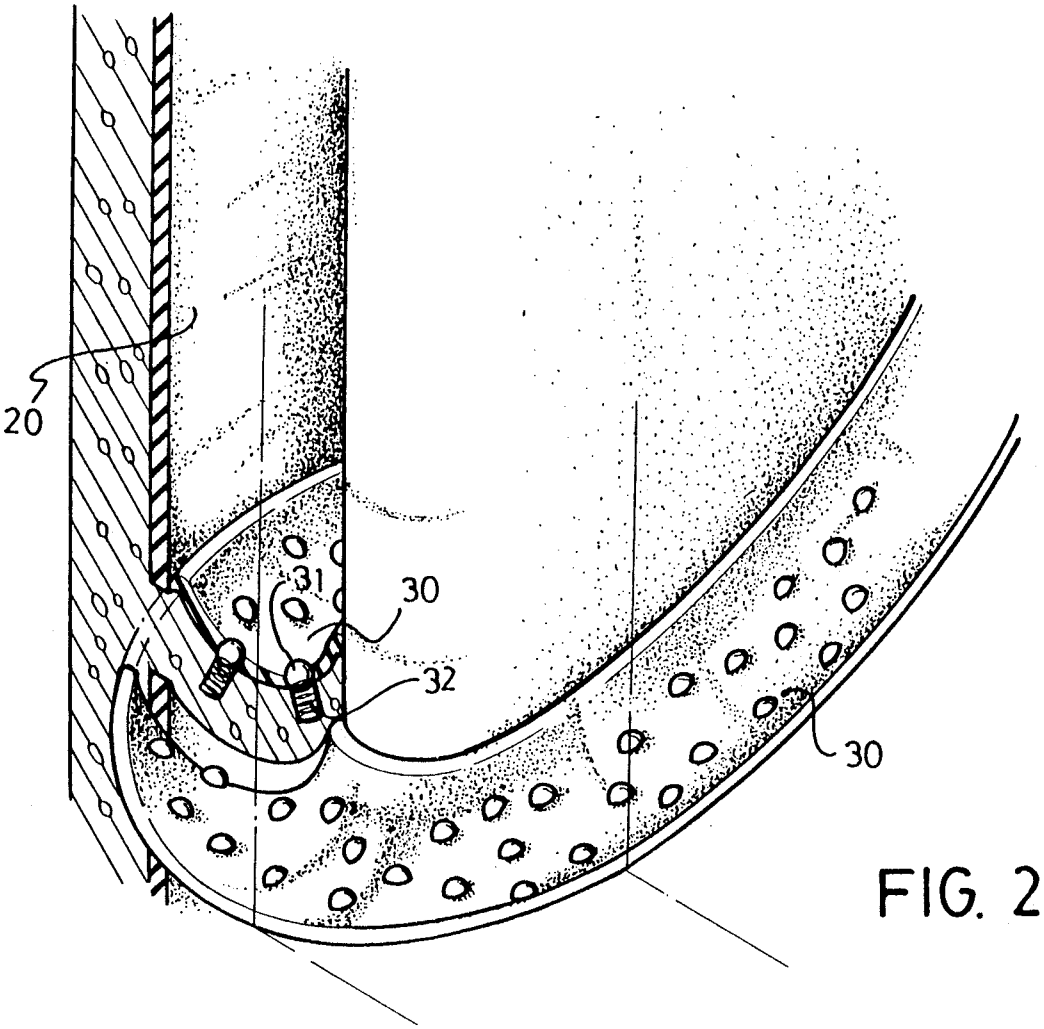
FIG. 2 is a partial perspective view illustrating another embodiment of the present invention.

Referring next to FIG. 2, a helical type pathway 30 is formed in the housing 20 and includes a plurality of protrusions disposed along the upper surface thereof which is preferably curved. Similarly, an opening is formed in each of the levels of the building and is communicated with the pathway 30. Each of the protrusions includes a ball 31 and a spring 32 received in a hole formed in the upper of the pathway 30. The balls 31 are biased outward of the holes and extend uptward beyond the upper surface of the pathway 30 such that a frictional force may apply to the user when the user slides downward along the pathway 30. The user of each of the levels may enter into the pathway 30 and may slide to any of the lower levels or to the ground in a fast speed via the pathway 30. The pathway 30 and the protrusions ar preferably made of fire resistant materials.

Alternatively, the resilient force or biasing force to the balls 31 can be substituted by similar devices such as pneumatic or hydraulic means. Further alternatively, instead of the protrusions, the upper surface of the pathway 30 may be made rough in order to apply frictional force to the user.

Accordingly, people can easily escape, in a fast speed, to the safety place, such as lower level of the building or the ground, via the fire escape in accordance with the present invention.

It is to be noted that the buffer plates 21 and the pathway 30 can be used as a recreational facility or as a sport facility so that people can use the fire escape at any time for fun and for recreational purposes in order that people can simulate and practice escaping during the usual days.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fire escape comprising a housing formed in a building which includes a plurality of levels each having an opening formed therein and communicated with said housing; and means disposed in said housing for transferring people to any lower level and to the ground, said means including a helical pathway formed in said housing and communicated with each of said openings so that people can slide to any lower level and to the ground via said pathway, said pathway including a plurality of holes formed in said upper surface thereof, a protrusion disposed in each of said holes, each of said protrusions including a spring and a ball received in said holes of said pathway, said balls extending outward beyond said upper surface of said pathway such that said protrusions provide a frictional force to said people.

* * * * *